United States Patent [19]

Turner et al.

[11] Patent Number: 4,704,730

[45] Date of Patent: Nov. 3, 1987

[54] MULTI-STATE SPEECH ENCODER AND DECODER

[75] Inventors: John M. Turner, Mountain View; Dana J. Redington, San Mateo, both of Calif.

[73] Assignee: Allophonix, Inc., Palo Alto, Calif.

[21] Appl. No.: 588,297

[22] Filed: Mar. 12, 1984

[51] Int. Cl.[4] ..... G10L 5/00

[52] U.S. Cl. ..... 381/36; 364/513.5

[58] Field of Search ..... 381/51–53, 381/41, 29–40

[56] References Cited

U.S. PATENT DOCUMENTS

| | | | |
|---|---|---|---|
| 3,890,467 | 6/1975 | Sciulli | 381/41 |
| 4,220,819 | 9/1980 | Atal | 179/1.5 A |
| 4,301,329 | 11/1981 | Taguchi | 179/1.5 A |
| 4,335,275 | 6/1982 | Brantingham | 381/51 |
| 4,354,057 | 10/1982 | Atal | 179/1.5 A |
| 4,536,886 | 8/1985 | Papamichalis et al. | 381/41 |
| 4,594,687 | 6/1986 | Kaneko et al. | 381/41 |

OTHER PUBLICATIONS

Atal, "Predictive Coding of Speech etc.," IEEE Trans. on Comm., vol. Comm-30, No. 4, pp. 600–614, Apr. 1982.

*Primary Examiner*—E. S. Matt Kemeny

*Attorney, Agent, or Firm*—Flehr, Hohbach, Test, Albritton & Herbert

[57] ABSTRACT

Audio signals are analyzed for predictable components (reflection coefficients) and non-predictable (residual) components. The original signal state, over a short-term interval of samples (packet) is defined as one of four states: Silence, Hiss, Sigma, or Peaky. The state determines the step-size encoding of the residual quantized signal, which can therefor be encoded more efficiently.

26 Claims, 10 Drawing Figures

*ENCODER*

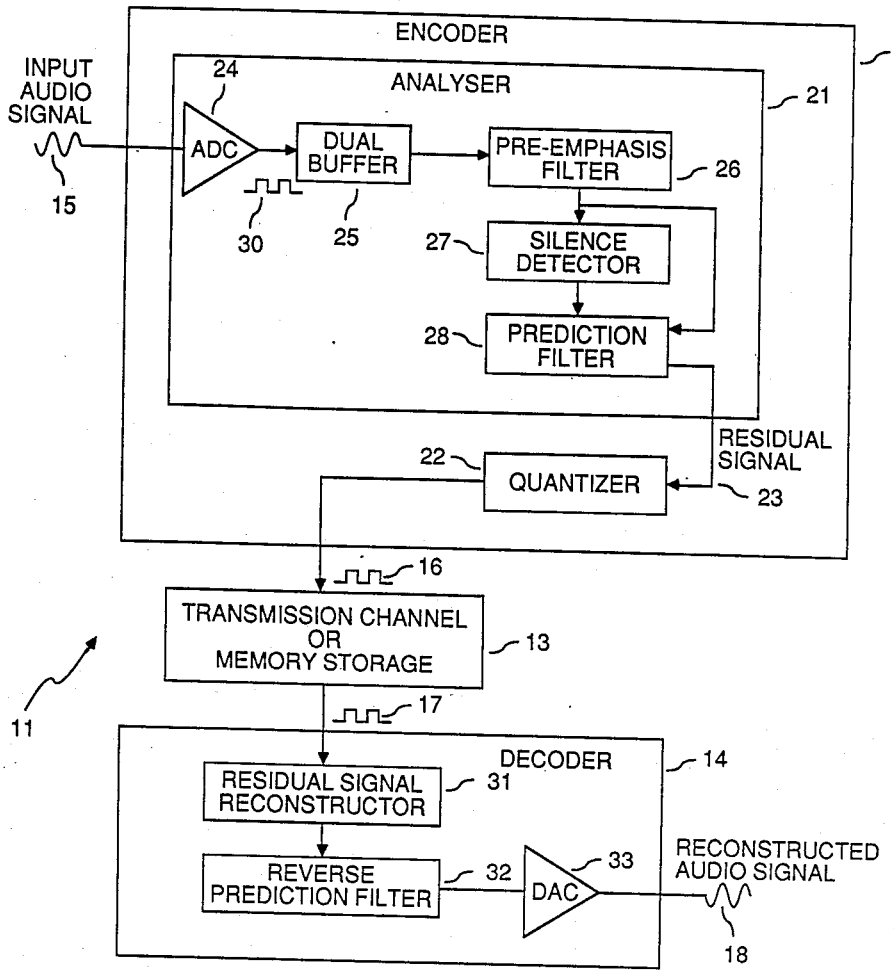
*FIGURE 1. AUDIO SIGNAL PROCESSING SYSTEM*

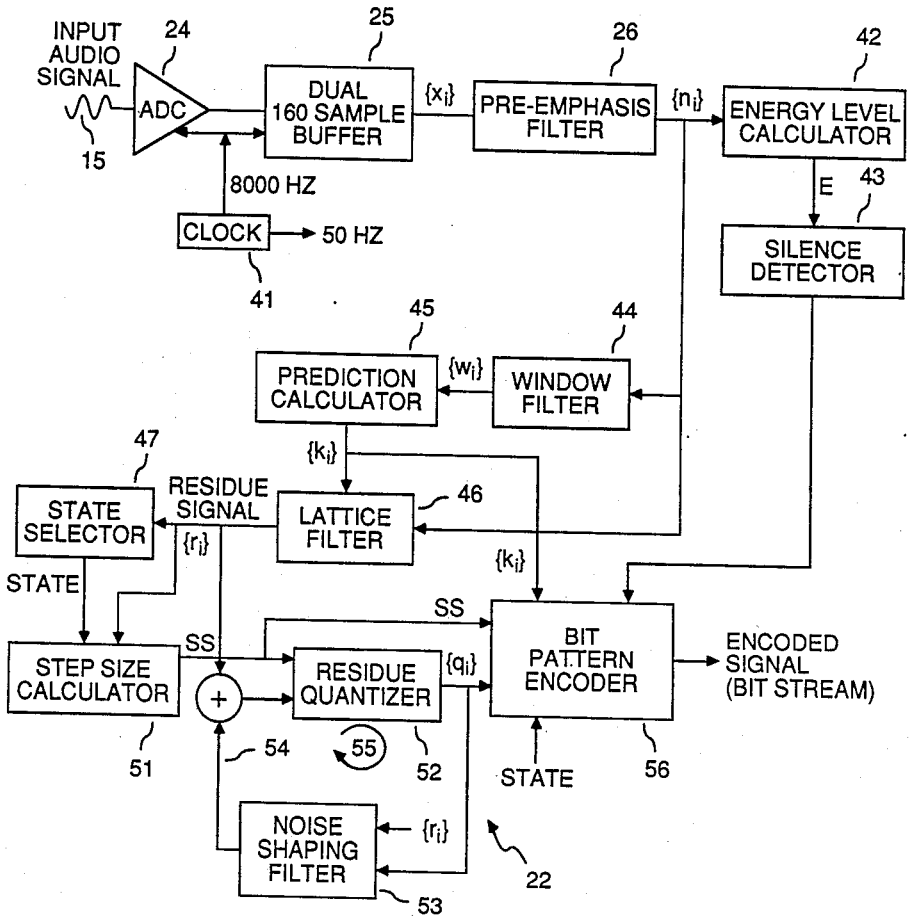
*FIGURE 2. ENCODER*

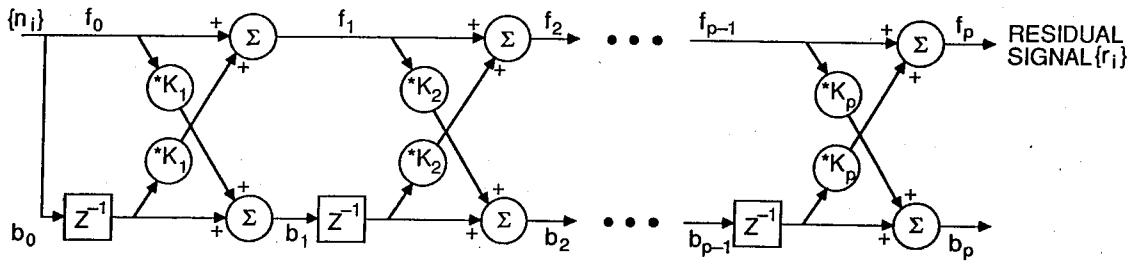
FIGURE 3A. FEEDFORWARD LATTICE FILTER
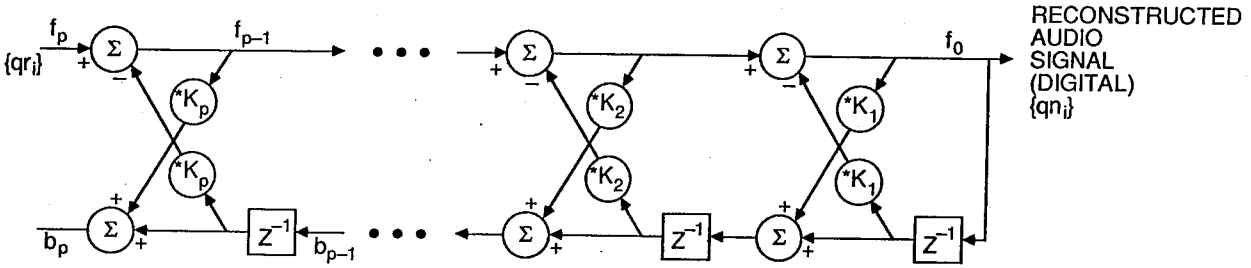
FIGURE 3B. FEEDBACK LATTICE FILTER

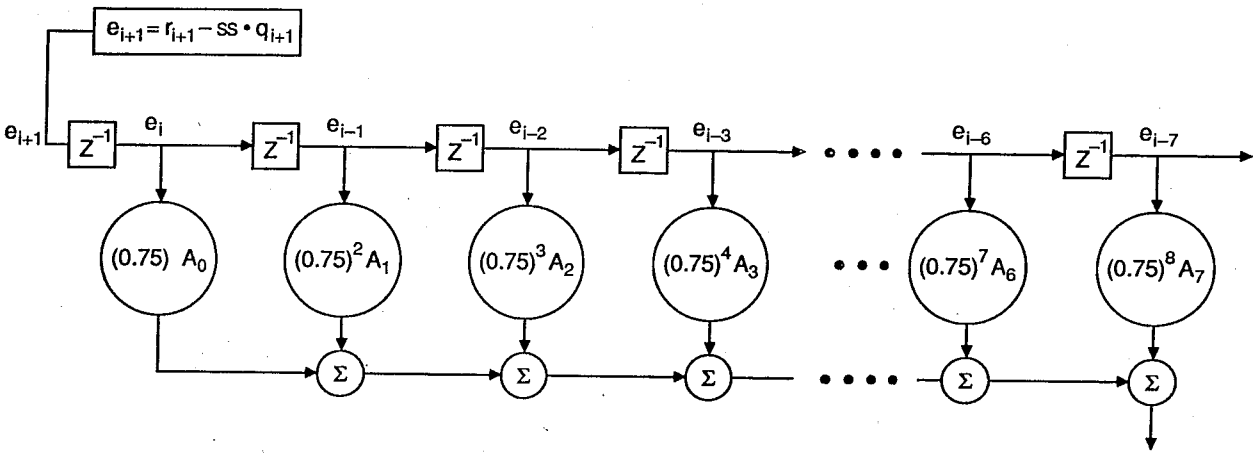
FIGURE 3C. NOISE SHAPING FILTER

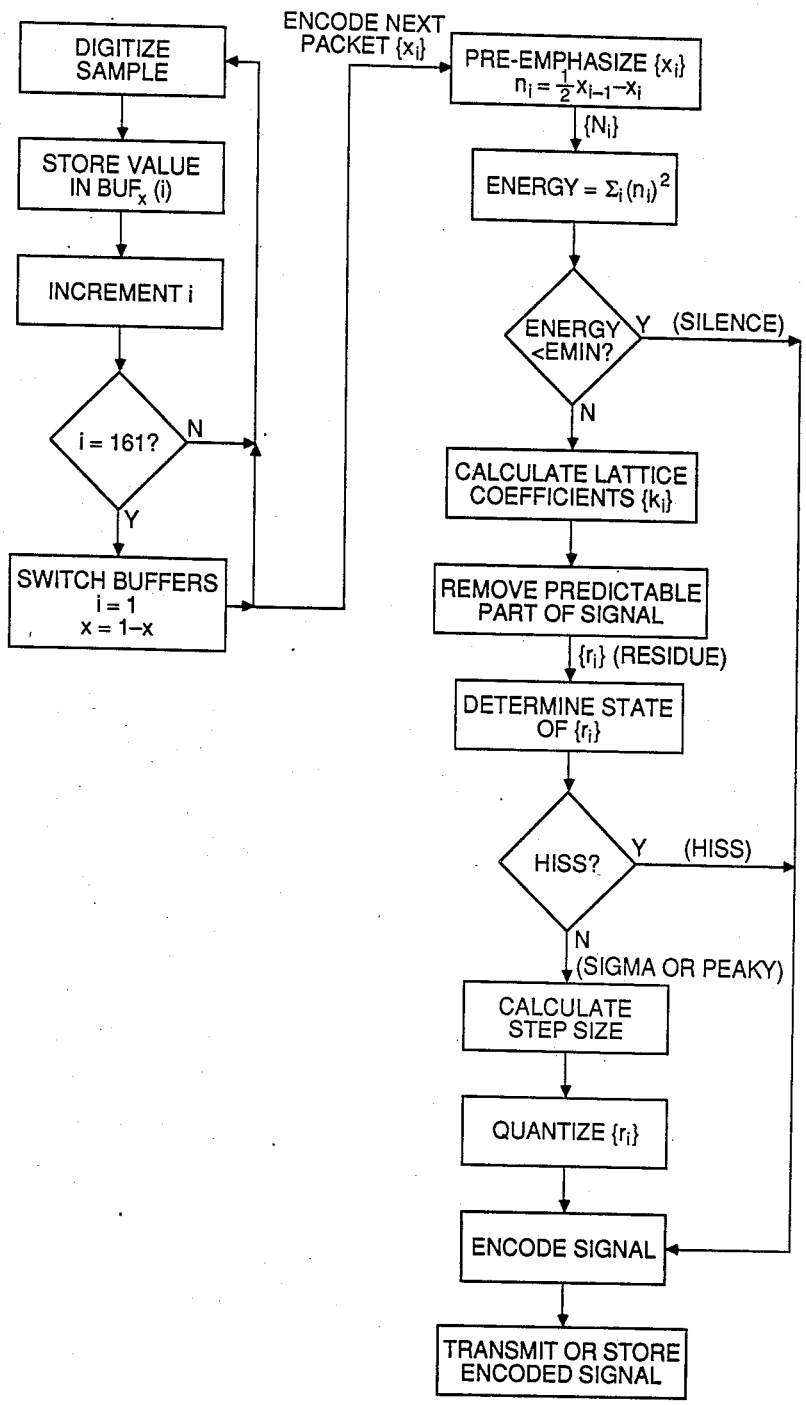
*FIGURE 5. SYSTEM FLOWCHART*

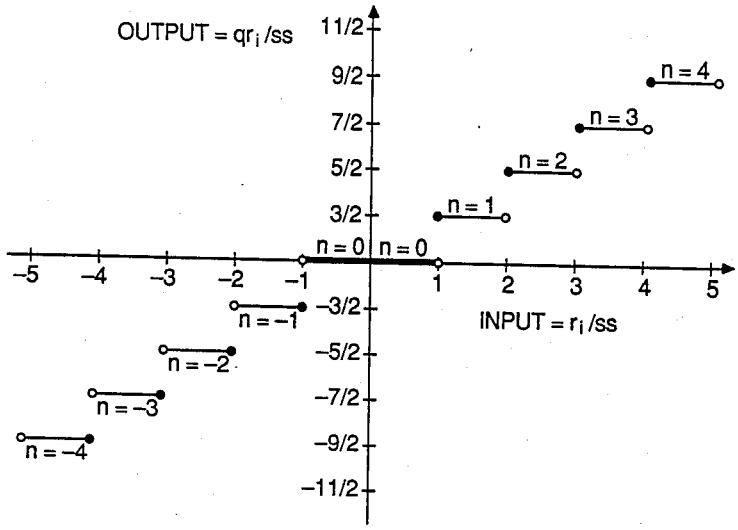
*FIGURE 6. RESIDUAL SIGNAL QUANTIZATION*
BITS: 6 2
| SSI | B4 | B1 | B2 | B3 | $q_i$, i = 1 TO 160 |
|---|---|---|---|---|---|
SSI = 0 SILENCE
= 1 HISS
= 2–63 INDEX TO QUANTIZED STEP SIDE TABLE
B1 TO B4 = LATTICE COEFFICIENTS (QUANTIZED)
$q_i$ = QUANTIZED RESIDUAL SIGNAL
*FIGURE 7. BIT MAP OF QUANTIZED SIGNAL*

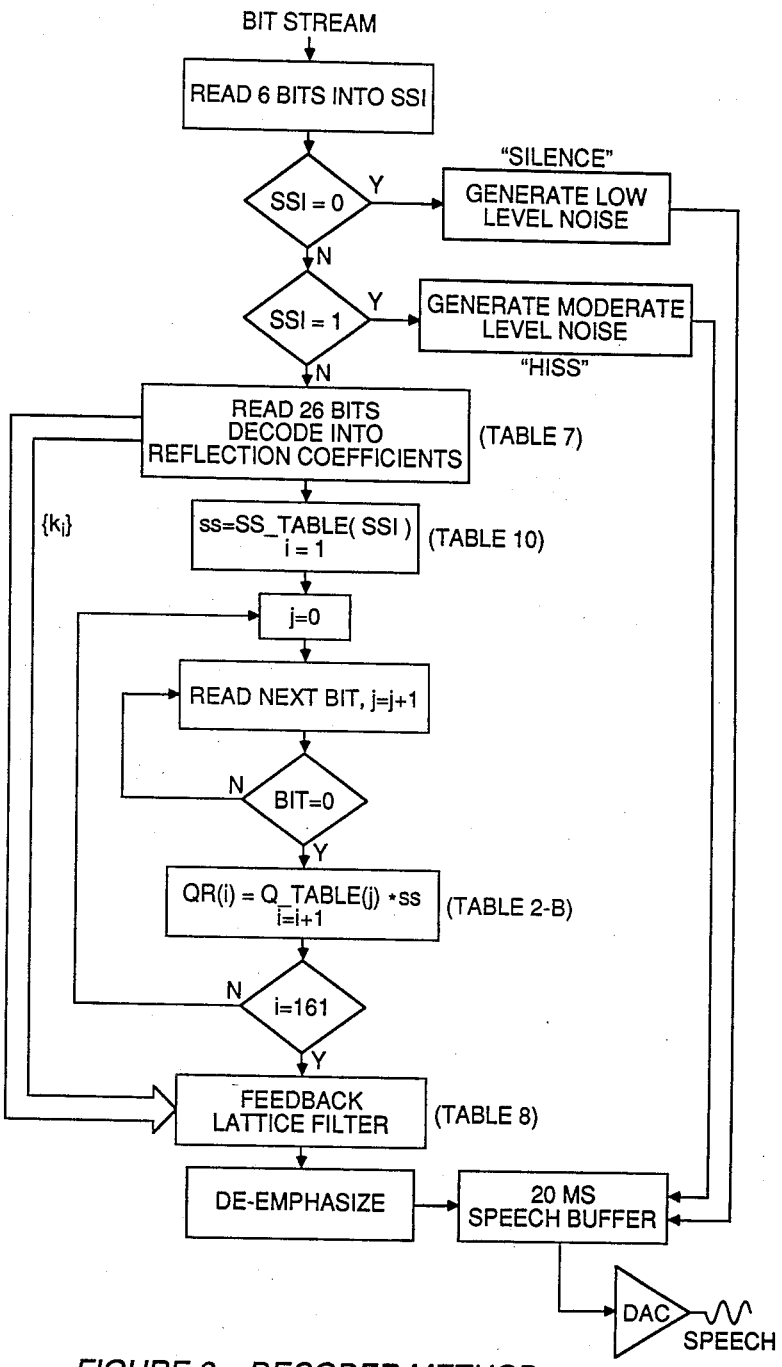
*FIGURE 8. DECODER METHOD*

MULTI-STATE SPEECH ENCODER AND DECODER

This invention relates generally to a signal communication system and more particularly to an apparatus and method for digitally encoding and decoding speech signals in real time.

A variety of methods have been used in the past to digitally encode speech and other audio signals for (fixed bit rate) transmission over telephone lines and other media. The goal of such methods is generally to maximize the quality of the sounds reproduced by the decoder portion of the system while minimizing the bandwidth (or bit rate) of the digital signal used. Another important goal is to be able to perform the encoding and decoding steps in real time—so that the system can be used as a standard audio transmitter/receiver. Most such systems use one form or another of linear predictive coding (LPC) or adaptive differential coding (ADPCM). The few commercially available systems that achieve real time signal processing are characterized by either fairly low quality speech reproduction and/or a high bandwidth (or bit rate).

Examples of commercially available audio signal processors are the OKI Semiconductor MSM5218RS ADPCM Speech Analysis/Synthesis IC and the Motorola MC3417 (and MC3418) Continuously Variable Slope Delta Modulator/Demodulator.

The basic theory of linear predictive coding (LPC) and certain other digital representations of the speech waveform is explained in L. R. Rabiner and R. W. Schafer, Digital Processing of Speech Signals, Prentice Hall, Signal Processing Series, New Jersey (1978). See especially chapters 5 and 8.

The closest prior art known to the inventor is (1) U.S. Pat. No. 4,354,057, Predictive Signal Coding with Partitioned Quantization (Atal) and (2 an IEEE article: Atal, Bishnu S., Predictive Coding of Speech at Low Bit Rates, IEEE Transactions on Communications, Vol. Com-30, No. 4, pp. 600–614 (April 1982). Other patents relating to the general subject matter of this invention include U.S. Pat. Nos. 3,624,302, Speech Analysis and Synthesis by the Use of the Linear Prediction of a Speech Wave (Atal); 3,631,520, Predictive Coding of Speech Signals (Atal); 3,662,115, Audio Response Apparatus Using Partial Autocorrelation Techniques (Saito et al.); 3,715,512, Adaptive Predictive Speech Signal Coding System (Kelly); 4,038,495, Speech Analyzer/Synthesizer Using Recursive Filters (White); 4,133,976, Predictive Speech Signal Coding with Reduced Noise Effects (Atal et al.); 4,220,819, Residual Excited Predictive Speech Coding System (Atal); 4,230,906, Speech Digitizer (Davis); 4,301,329, Speech Analysis and Synthesis Apparatus (Taguchi); 4,340,781, Speech Analyzing Device (Ichikawa et al.); and 4,376,874, Real Time Speech Compaction/Relay with Silence Detection (Karban et al.).

It is a primary object of the present invention to provide an improved audio signal encoder/decoder system and an improved speech storage system.

Another object of the present invention is to provide a system responsive to the complexity (or quality) of the sounds being encoded such that different classes of sound signals are encoded differently, thereby lowering the bandwidth needed to encode the sound signals. Lower bit rates are used to encode simple sounds and higher bit rates are used to encode complex sounds.

Another object of the present invention is to provide techniques for audio signal processing in real time using available micro-processor technology.

In accordance with these objectives the present invention provides an apparatus and method for digitally encoding an audio signal in accordance with the state of that audio signal. The state of the signal is generally a function of (1) the energy of the signal before the predictable part is removed, (2) the energy of the signal after the predictable part is removed, and (3) the peak value of the signal after the predictable part is removed. A distinct encoding scheme is used for each of at least three distinct signal states. Furthermore, periods of silence are detected and encoded as such. Real time computation techniques include the use of a truncated set of quantized lattice coefficients to represent the predictable part of the audio signal and the use of table look-up methods to reduce the number of computations required for processing the audio signal.

The invention and objects and features thereof will be more readily apparent from the following detailed description and appended claims when taken in conjunction with the drawings, in which:

FIG. 1 is a block diagram of an audio signal processing system in accordance with the present invention.

FIG. 2 is a block diagram of an audio signal encoding apparatus in accordance with the present invention.

Figure 4:
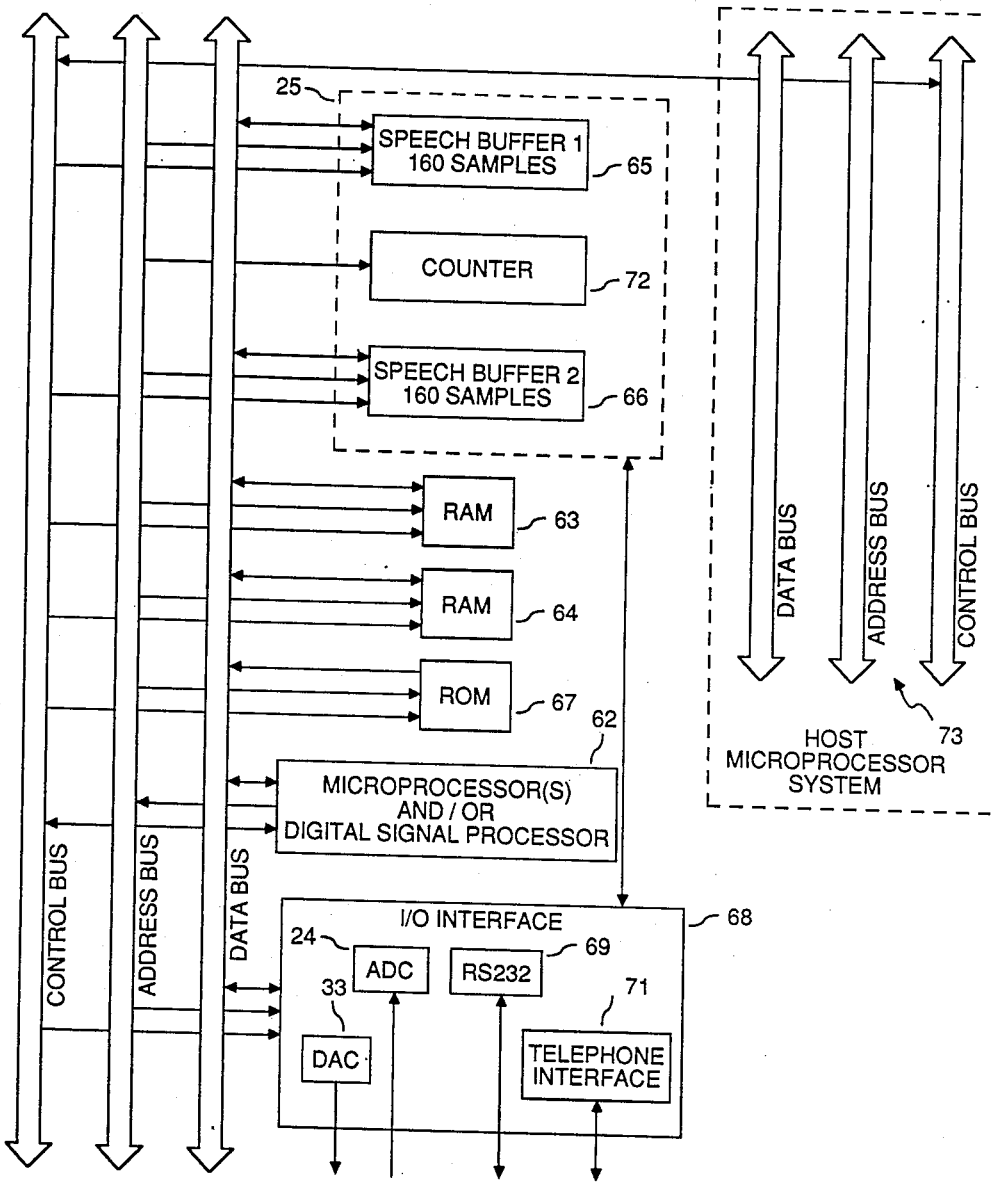

FIGS. 3*a* and 3*b* are schematic diagrams of the lattice filter used to remove and restore the predictable part of the audio signal. FIG. 3*c* is a schematic diagram of a noise shaping filter.

FIG. 4 is a block diagram of a microprocessor-based computer add-on device incoporating the invention.

FIG. 5 is a flow chart of the method used to encode an audio signal.

FIG. 6 is a schematic diagram of how the residual signal is quantized.

FIG. 7 is a schematic diagram of how the audio signal is encoded for transmission or storage.

FIG. 8 is a flow chart of the method used to decode transmitted or stored data into an audio signal.

Referring to FIG. 1, there is shown an audio signal processing system 11 generally including an encoder 12, a transmission channel and/or memory storage device 13, and a decoder 14. The encoder 12 converts an input audio signal 15, which is typically human speech into a digital signal 16. The digital signal 16 may be transmitted via channel 13 to a different location and/or may be stored in a digital memory 13 for use at a later time. The decoder 14 receives a digital input signal 17, which is generally equivalent to the output signal 16 just mentioned, and converts it back into a reconstructed audio signal 18.

The general strategy used by the encoder 12 is to characterize the input audio signal in terms of the amount of information content therein. In the preferred embodiment the input audio signal is sampled 8000 times per second (i.e., every 125 microseconds) and is characterized 50 times per second (i.e., every 20 milliseconds) using the most recent 160 samples. Each set of 160 samples comprises a distinct packet that is characterized as either (1) SILENCE, (2) HISS, (3) PEAKY, or (4) SIGMA. The amount of data required to encode each 20 millisecond packet depends of the state of the sample. Packets characterized as silence or HISS do not need detailed encoding of the 160 samples in the packet; they are encoded using only a special 6-bit code to identify the state of the packet. Packets characterized as either PEAKY or SIGMA require detailed encoding of the time domain residual signal, but different encoding schemes are used for each in order to maximize the quality of information per bit transmitted. The number of bits transmitted per packet is variable. In some embodiments (e.g., systems where the digitized signal is transmitted as the input signal 15 is encoded) a synchronization signal is used to mark the beginning of each 20 millisecond packet of encoded data. In systems where the encoded signal 16 is stored for later transmission or use, a synchronization signal is usually not needed.

The basic structure of the encoder 12 includes an analyzer 21 and a quantizer 22. The analyzer 21 determines the type of input signal 15 that has been received, and if appropriate, removes the predictable part of the signal. This leaves a residual signal 23 which is quantized in an efficient manner in accordance with the state (i.e., characteristics) of the input signal 15.

At a slightly more detailed level the analyzer includes an analog-to-digital converter (ADC) 24 for converting the input audio signal 15 into a digitized signal 30. The digitized signal 30 is stored temporarily in a dual buffer 25. The data in the dual buffer 25 is then processed by a preemphasis filter 26, a silence detector 27 and a prediction filter 28. The resulting residual signal 23 and other parameters (described below) are used to quantize the input audio signal 15.

The basic structure of the decoder 14 includes a residual signal reconstructor 31, a reverse prediction filter 32, and a digital-to-analog converter 33. The decoder 14 decodes signals that were encoded in accordance with the invention and produces a reconstructed audio signal 18.

Referring now to the block diagram of FIG. 2 and the flow chart of FIG. 5, a preferred embodiment of the encoder 12 works as follows. The input audio signal 15 is typically derived from a microphone (not shown). A standard analog-to-digital converter (ADC) 24 converts athe analog input signal 15 into a 12-bit digital value $X_i$ every 125 microseconds (i.e., 8000 times per second). The digital value $X_i$ produced by the ADC 24 represents the amplitude of the input signal 15 at each sample time. The calibration of the ADC 24 generally requires that the maximum possible digital value produced by the ADC 24 correspond to an amplitude somewhat higher than the loudest input signal 15 the system is expected to accurately encode.

A dual 160 sample buffer 25 is used to temporarily store the digitized amplitude values $X_i$. While new values $X_i$ are being stored in one half of the dual buffer 25, the values in the other half are processed by the encoder 12. Each digitized amplitude value is stored in the next sequential location in one half of the dual buffer 25 until 160 samples have been stored. Then the digitized amplitude values are stored in sequential locations in the other half.

Using the stored sample values, the encoder 12 processes the stored audio information as follows. First the audio data $X_i$ is pre-emphasized by filter 26, wherein each sample value is replaced with a value $$n_i = \tfrac{1}{2}X_{i-1} - X_i \text{ (where i=1 to 160).} \qquad \text{(Eq.1)}$$

This type of preemphasis is well known to those skilled in the art as a simple method of evening out the spectral energy distribution in speech signals. Upper frequencies are emphasized to yield a new signal $n_i$ with a flatter spectrum that the original signal $X_i$. All further calculations performed in the encoder 12 are based on the preemphasized signal $n_i$.

The first step after pre-emphasis is to calculate the energy of the 160 sample signal packet (block 42) using the formula $$E_SP = \text{sum } (n_i^2),\ i = 1 \text{ to } 160. \qquad \text{(Eq.2)}$$

In the simplest case, if the energy E_SP falls below a set value, $E_{min}$, then the whole packet is encoded as silence (i.e., as a SILENCE state signals packet) and the remainder of the encoding process is circumvented. In the preferred embodiment, the silence detector 43 uses a hysteresis type of model for silence detection. When the previous 160 sample time interval was encoded as silence, the current time interval is encoded as silence if the energy E_SP falls below a first threshold value $E_{m1}$. When the previous 160 sample time interval was not encoded as silence a second, lower silence threshold value $E_{m2}$ is used. Therefore, once silence is detected in one time interval, a somewhat higher threshold value of noise (or signal) must be detected than otherwise in order for the input signal not to be encoded as silence. This dual threshold silence detection helps minimize the amount of data required to encode silence, but allows detailed encoding of low amplitude signal packets occurring in the midst of higher amplitude packets. These low amplitude signal packets are more likely to contain significant information than packets occurring in the midst of silence.

Assuming that the current signal packet $n_i$ is not to be encoded as silence, the signal is next processed by a prediction filter 28. The prediction filter 28 comprises a window filter 44, a prediction calculator 45, and a lattice filter 46. The method used by the prediction filter 28 follows methods generally well known to those skilled in the art. However certain specific improved aspects of the prediction filter 28, as described below, are designed for real time signal processing. Window filter 44 smooths the edges of the signal packet to reduce the effect of the beginning and ending sample values on the signal prediction process. In the preferred embodiment, the windowed signal $$W_i = wf(i) * n_i,\ i = 1 \text{ to } 24,\ 137 \text{ to } 160 \qquad \text{(Eq. 3)}$$

$$= n_i,\ i = 25 \text{ to } 136$$

where $$wf(i) = \cos^2(\text{pi}(1 - i/32)/2),\ i = 1 \text{ to } 24 \qquad \text{(Eq. 4)}$$

$$= wf(161 - i),\ i = 137 \text{ to } 160.$$

By windowing only 48 of the 160 sample values, the number of multiplication operations required to window the signal packet is drastically reduced without any noticeable sacrifice in signal quality. Furthermore, the wf(i) values are approximated by using the closest value, QK, in the quantized reflection coefficients table (Table 1) to the values derived from equation 4, shown above. Table look-up of the wf(i) values facilitates real time processing. In the preferred embodiment a sixteen-bit microprocessor calculates $W_i$ by (1) using the value of QK(i) closest to wf(i) from Table 1 (approximately equal to $2^{15}$ times the values shown in equation 4 above); (2) performing an integer multiplication of $n_i$ * wf(i); and (3) shifting the result left one bit and using the top 16 bits of the 32-bit result as $W_i$.

The prediction calculator 45 calculates the lattice coefficients $K_i$ needed to remove the predictable part of the digitized signal $n_i$. These lattice coefficients are also known in the art as ladder coefficients or as reflection coefficients. In the preferred embodiment, a lattice filter 46 of the type shown in FIG. 3*a* is used to remove the predictable part of the signal $n_i$. Referring to FIG. 3*a*, the lattice coefficients are denoted $K_i$, the residual signal is denoted $r_i$, the capital Greek letter sigma denotes summation, $Z^{-1}$ denotes a time delay of one sample period (125 microseconds in the preferred embodiment), the arrows denote the flow of data through the lattice, and the $b_i$ and $f_i$ values are intermediate lattice node values. A mathematical algorithm corresponding to the lattice is shown in Table 4.

In the preferred embodiment a lattice filter 46 having eight lattice coefficients is used. This particular choice (i.e., of an eighth order lattice) is somewhat arbitrary, but selected to give a high ratio of signal quality to calculation complexity. The algorithm for calculating these coefficients $K_i$ is well known in the art as the Leroux-Geuguen formula and is shown in detail in Table 3. These coefficients are then "quantized" by looking for the closest value $QK_i$ to each $K_i$ value in a special table of lattice coefficients. See Table 1. For each coefficient, only a selected range of table values is allowed. The selected range for each coefficients corresponds to the values typical for speech signals. By so limiting the range of quantized coefficients $QK_i$, these coefficients can be efficiently encoded for storage or transmission, as will be described in detail below.

The quantized reflection coefficients in Table 1 are scaled up by a factor of $2^{15}$ to facilitate the use of integer arithmetic, as explained in more detail below. For a given (calculated) coefficient K, the quantized reflection coefficient $QK_i$ is selected by finding the largest value of i such that K is less than $Q_i$ in Table 1.

Once the lattice coefficients $QK_i$ have been calculated, the 160 signal values $n_i$ from the signal packet are run through the lattice filter shown in FIG. 3*a*. For convenience, the coefficients are denoted $K_i$ in FIG. 3*a* rather than $QK_i$. A mathematical algorithm for carrying out this filtering process is shown in Table 4.

The next step in the process is to select the state of the residual signal $r_i$. See Table 5 for an algorithmic representation of the state selection process. Three parameters are used by the state selector 49; (1) PV, the peak value of the residual signal (i.e., the largest amplitude value in the 160 residual sample values in the packet being processed); (2) the square root of the signal energy after lattice filtering; and (3) the prediction gain, which is the ratio of the signal energy before lattice filtering to that after filtering.

Since in the preferred embodiment only integer arithmetic is used, the parameters for state selection are calculated in the following way. The computed prediction gain, PG, is four times the sum of the squared signal data before lattice filtering, $E_{13}$ SP, divided by the sum of the squared signal data after lattice filtering, E_RS. The computed square root of the signal energy, CC, has been qauntized using Table 11 as follows. By successive division by two, E_RS is expressed as $$E_RS = A*2^B, \quad \text{(Eq.5)}$$

where B is an even integer and A is less than 32768. (If $E_{13}$RS was already less than 32768 then B equals zero and A equals the original value of E_RS.) Using Table 11, the lowest index i is found such that QE(i) is greater than A. The computed square root, CC, is QN(i) shifted left by B/2 bits. The structure of Table 11 is such that the values of QE(i) and QN(i) are logarithmically spaced:

$$2 * QE(i) = QE(i + 4)$$

$$2 * QN(i) = QN(i + 8)$$

$$QN(i) = 4 * SQRT(QE(i)).$$

(Note that SQRT(a) is used herein to mean the square root of a.) The variance of the signal, SIgma, is $$\text{Sigma} = \text{SQRT}(E_RS/160), \quad \text{(Eq.6)}$$

so that the square root of the signal energy, CC, is $$CC = 4*\text{SQRT}(160)*\text{Sigma}. \quad \text{(Eq. 7)}$$

The ratio, PE, of the peak signal value, PV, to signal variance, Sigma, is computed as $$PE = 203*PV/CC \quad \text{(Eq.8)}$$

and is approximately equal to 4 * PV/Sigma. In the SIGMA state, the data quantizer step size, ss, is computed as $$ss = CC/84 \quad \text{(Eq.9)}$$

and is equal approximately to 0.6 * Sigma.

The HISS state is used for low amplitude portions of hiss-type signals. In this state, the information content of the residual signal is minimal and does not need to be encoded in detail. The residual signal quantization process is circumvented and random noise is used for the reconstructed speech. The level of this noise is louder than that used for reconstructed silence. The HISS state is chosen when the prediction gain, PG, is less than a preselected threshold (e.g., 6 in the preferred embodiment) and the residual signal energy, E_RS, is less than a preselected threshold (e.g., 32000 in the preferred embodiment).

In other embodiments, the HISS state could generate spectrally shaped noise at an energy level matching the original hiss sound energy. This would require encoding the step size (to indicate the noise energy) and the reflection coefficients. Then the random noise would be scaled to the proper energy and passed through the lattice filter using the reflection coefficients. For the limited frequency range of the telephone network there is little perceptual difference between the former flat spectrum hiss and the latter spectrally shaped hiss.

If the residual signal is not characterized as HISS, then it is tested to determine if it is best characterized as being in a SIGMA or in a PEAKY state. The SIGMA and PEAKY states are used for most of loudly spoken portions of the input signal. The SIGMA state identifies a sound that is close to the classical model for vowel sounds in speech signals: periodic prediction error spikes repeated at an even pitch period with zero residual signal amplitude between spikes. The PEAKY state identifies the occurrence of many high amplitude components in the residual signal. This corresponds to a lower prediction gain, PG, value and a lower ratio, PE, than is associated with SIGMA state signals.

The residual signal is classified as being in a SIGMA state if (1) the prediction gain, PG, is greater than 8; (2)

the peak value, PV, is greater than a predetermined value, $PV_{sgm}$; and (3) the ratio, PE, of the peak value to signal variance, as calculated in equation 8 above, is greater than 9. Otherwise the residual signal is classified as being in a PEAKY state.

If the residual signal is in a SIGMA state, the residual sample values $r_i$ are quantized using a step size, SS, equal to CC/84 (approximately 0.6 of the signal variance), as calculated in equation 9 above.

In the PEAKY state, using a step size of approximately one quarter the peak value to quantize the residual signal maps much of the residual signal into zero, reduces the bit rate needed to encode the residual signal considerably (compared with using the step size associated with the quantization of SIGMA state signals) without any perceivable sacrifice in sound quality. The actual step size used should generally be between one third and one fifth of the peak value in order to retain sufficient information in the encoded signal.

The actual step size used, for either SIGMA or PEAKY state signals, is selected from a predefined table of quantized step size values SS, using the value in Table 10 that is closest to the calculated step size value ss. Table 10 contains values of CC/84 rounded to an even value.

Referring to FIG. 6, the residue quantizer 52 quantizes each value $r_i$ using the quantized step size SS by mapping all positive values of $r_i$ less than (n+1)*SS and greater than or equal to n*SS into a value of n, and all negative values of $r_i$ less than or equal to −n*SS and greater than (−n−1)*SS into a value of −n. All sample values between −SS and +SS are quantized into zero. This center clipping converts much of the residual signal into a zero value. The range of input values mapped into zero is twice as large as that mapped into non-zero values. In the speech reconstruction process, for an index n the value, $qr_i$, of the reconstructed residual signal is:

$$qr_i = 0, \text{ if } n = 0 \qquad \text{(Eq. 10)}$$
$$= (n + \tfrac{1}{2})*SS, \text{ if } n \text{ is greater than } 0$$
$$= (n - \tfrac{1}{2})*SS, \text{ if } n \text{ is less than } 0$$

In the preferred embodiment the quantizer is limited to 7 positive steps, 7 negative steps and the zero bin. The outer levels are rarely used. In other embodiments, other residue quantization schemes could be used. For instance, all the step sizes could be made equal, each step could be made a different size, or the number of steps could be given a lower upper limit (i.e., signal peaks above a certain level could be clipped, and so on.

The spectral distribution of the noise caused by the type of quanitization shown in FIG. 6, called quantization noise, can be redistributed so as to reduce the amount of noise perceived by using a noise shaping filter 53. In the preferred embodiment, the noise shaping filter 53 comprises a modified prediction filter, with the output 54 of the filter 53 added to the residual signal $r_i$ in a feedback loop 55. As shown in FIG. 3c, the noise shaping filter 53 is basically a tapped delay line, with coefficients related to the lattice coefficients $K_i$ of the feedforward lattice filter by Levinson's formula. The algorithms (i.e., Levinson's formula) for calculating the filter coefficients $A_i$ and performing noise filtering are shown in Table 6. Note that in terms of Levinson's formula:

$$\text{Feedback Noise}_{i+1} = (0.75)*A_0*Err_i + (0.75)^2*A_1*Err_{i-1} + (0.75)^3*A_2*Err_{i-2} \ldots + (0.75)^8*A_7*Err_{i-7}$$

but that in Table 6, the feedback noise coefficients $A_i$ are calculated so as to already include the appropriate power of 0.75.

The pattern encoder 56 collects information from the silence detector 43, state detector 49, step size calculator 51, and residue quantizer 52 and encodes for storage or transmission. For each 160 sample packet the following information is sent. The first six bits comprise a step size index. See Table 10. The step size index SSI refers to a predetermined table of step size values containing up to 62 possible step size values. (The embodiment shown in Table 10 contains 37 possible step size values.) If the signal is encoded as silence, then the step size index SSI is set to zero. If the signal packet is encoded as HISS, then the step size index SSI is set to 1. Otherwise the step size index SSI refers to the table of step size values. If the signal packet is encoded as silence or HISS, only the step size index in encoded for the packet and no other information is transmitted or stored. (In a second preferred embodiment 8 bits are stored because of the convenience of having each signal packet begin on a standard byte boundary in memory).

For non-silent signal packets the eight lattice coefficients $K_i$ are encoded into 26 bits as follows. Each coefficient is translated into an index $KI_i$ to the possible values that the coefficient may have. Referring to Table 1, in the preferred embodiment there are 27 preselected values for lattice coefficients used in the lattice filter. Table 1 shows which values are available for use by which coefficient. Note that the values in Table 1 are scaled up by a factor of $2^{15}$ for ease of use in integer computations. (When multiplying one of these scaled coefficients times another 16-bit number, the 32-bit result is shifted one bit left, and then the top 16 bits comprise the properly scaled result.) The most significant coefficients have the widest range of available values. Referring to FIG. 7, the encoded lattice coefficients are calculated as three 8-bit parcels, B1 through B3, and one 2-bit parcel B4, as follows:

$$B1 = (KI_1 - 5) + 23*(KI_4 - 15) \qquad \text{(Eq. 11)}$$

$$B2 = (KI_2 - 15) + 16*(KI_3 - 8) \qquad \text{(Eq. 12)}$$

$$B3 = (KI_7 - 13)/2 + 4*(KI_6 - 16) + 32*(KI_5 - 11) \qquad \text{(Eq. 13)}$$

$$B4 = (KI_8 - 16)/2 \qquad \text{(Eq. 14)}$$

where "$KI_i$" is the index to the quantized value of $K_i$ in Table 1

If the signal packet is a SIGMA or PEAKY state signal, the 160 quantized residual sample values are encoded in accordance with Table 2-A. Table 2-A comprises a variable bit scheme for encoding information, whereby low values use less bits than large values. Since many of the quantized residual sample values will have a small or zero value, this scheme will generally result in a lower bit rate than a scheme using a fixed number of bits per sample value.

The operation of the decoder 14 is relatively simple in comparison to the encoder 12. FIG. 8 shows the method used by the decoder to reconstruct an audio signal from the encoded signal 17. For each signal packet the state of the signal is determined from the value of the step size index SSI. If the signal packet is encoded as SILENCE (i.e., if SSI=0) then low level random noise is generated. If the signal packet is encoded as HISS (i.e., if SSI=1) then somewhat louder random noise is generated. Random noise can be generated by a fixed pseudorandom sequence, by a polynomial counter, by accesses to random memory locations or by the method shown in Table 9. The random noise is scaled to a low energy for SILENCE and approximately four times louder for HISS. Random noise provides a gentler transition between silent and non-silent signal packets than pure silence would.

If the signal packed is not encoded as SILENCE or HISS then the 26-bit lattice coefficient parameter is decoded into eight lattice coefficients using the formulas shown in Table 7. These lattice coefficients are used in the feedback lattice filter 32 shown in FIG. 3*b*. The residual sample values are feed into the lefthand side of the filter 32 and the reconstructed audio signal comes out the righthand side. The algorithm for reconstructing the audio signal using the feedback lattice filter is shown in Table 8.

If the signal packet is not encoded as either SILENCE or HISS, each of the 160 residual sample values is decoded in accordance with the scheme shown in Table 2-B. The step size is obtained by looking up the value in a table (e.g., Table 10) using the 6-bit step size index value SSI. In other words, for each sample value in the signal packet the encoded signal is read in until a zero bit is found. The sample value is then obtained by looking up the quantized value (n) in Table 2-B (using the number of bits in the encoded sample value as an index) and then applying equation 10, shown above.

Referring to FIG. 4, in the preferred embodiment, the encoder 12 and decoder 14 comprise a single add-on board 61 for a micro- or mini-computer 73. The encoder 12 and decoder 14 share a microprocessor 62, random access memory 63–66, and read-only memory (ROM) 67. The ROM 67 contains prerecorded computer programs used by the microprocessor 62 to analyze and encode digitized audio signals and to reconstruct encoded audio signals. The dual ported buffer 25 includes two separate dual-ported buffers 65 and 66, each holding 160 addressable 12-bit values. A counter 72 driven by a (software) 8000 Hz clock calculates the current location in the dual buffer 25 to store the current digitized amplitude value. Generally, only the encoder 12 or decoder 14 can be used at any one time since they share resources. The encoder 12 must be attached to a microphone, telephone or equivalent device to received input audio signals. A speaker, telephone or equivalent device must be attached to the decoder 14 for transmission of the reconstructed audio signal 18. Input and output channels are provided by an I/O interface 68, which includes an ADC 24 for digitizing input audio signals, a DAC 33 for converting reconstructed digital audio signals into analog signals suitable for input into an audio amplifier, and an RS232 69 interface and a telephone interface 71 for transmission of data to other computer devices. The output from the encoder 12 can be stored in memory 63–64 for later transmission or can be transmitted immediately to one or more remote destinations via interface 68. Similarly, input to the decoder 14 can be processed as the data is received or can be buffered and then processed.

Clearly, the invention can be embodied in many different configurations than the one shown in FIG. 4. If both the encoder 12 and decoder 14 need to be able to work simultaneously then two microprocessors would be used instead of one. In some systems it might be advantageous to use a signal processor to handle some of the signal processing tasks and to use a microprocessor to handle more of the basic information handling and parsing tasks, thereby allowing the use of a less expensive and less powerful microprocessor. In such a configuration the basic, unvarying signal processing routines could be programmed into the signal processor, leaving only control level routines (e.g., answering incoming telephone messages and initiating the sending of telephone messages) to be handled by the microprocessor.

There are three preferred embodiments of the speech encoder/decoder using current microprocessor technology: (1) a multi-purpose peripheral board that installs into a personal computer (as shown in FIG. 4) and uses either "off the shelf" microprocessors (such as the Intel 8086 plus 8087(s), Motorola 68000 plus 68881, or Intel 80386 plus 80387; with or without hardware multipliers or look up tables in memory) and/or digital signal processing chips (such as the Fujitsu MB8764, TI TMS32010, NEC UPD7720, AMI S2811, or Intel 2920); (2) a custom chip or chip set that is functionally equivalent to the encoder 12 and decoder 14; or (3) a co-processor chip with the functional equivalent of the encoder 12 and decoder 14.

As indicated earlier, since the bit rate associated with the encoded signal 16 varies in accordance with the state of the input audio signal 15, the output of the encoder 12 must be buffered before transmission over a fixed bit rate signal transmission system. In the preferred embodiment the encoded signal 16 is temporarily buffered in accordance with a scheme whereby data is simultaneously being added to one "end" of an output buffer as data at the other "end" is being transmitted, with certain precautions taken to prevent buffer overflow or underflow. In applications where the encoded message is to be transmitted via a telephone network to multiple destinations, the whole message is stored before transmission begins.

While the present invention has been described with reference to a specific embodiment, the description is illustrative of the invention and is not to be construed as limiting the invention. Various modifications may occur to those skilled in the art without departing from the true spirit and scope of the invention as defined by the appended claims. In particular the number of signal states used and the exact boundary lines between the state can vary with the particular application. Similarly, many of the details of the encoding scheme and the particular values in the various tables are somewhat arbitrary and can be changed without departing from the substance of the invention.

TABLE 1

| | Q1 | QK | W | Available for use by | | | | | | | |
|---|---|---|---|---|---|---|---|---|---|---|---|
| KI | Value | Value | (i) | $K_1$ | $K_2$ | $K_3$ | $K_4$ | $K_5$ | $K_6$ | $K_7$ | $K_8$ |
| 1 | −31518 | −31845 | | | | | | | | | |
| 2 | −30628 | −31073 | | | | | | | | | |
| 3 | −29512 | −30070 | | | | | | | | | |
| 4 | −28176 | −28844 | | | | | | | | | |
| 5 | −26630 | −27403 | | x | | | | | | | |
| 6 | −24882 | −24758 | | x | | | | | | | |
| 7 | −22958 | −23922 | | x | | | | | | | |
| 8 | −20858 | −21908 | | x | | x | | | | | |

TABLE 1-continued

| KI | Q1 Value | QK Value | W (i) | Available for use by $K_1$ | $K_2$ | $K_3$ | $K_4$ | $K_5$ | $K_6$ | $K_7$ | $K_8$ |
|---|---|---|---|---|---|---|---|---|---|---|---|
| 9 | −18602 | −19730 | | x | | x | | | | | |
| 10 | −16210 | −17406 | | x | | x | | | | | |
| 11 | −13696 | −14953 | | x | | x | | x | | | |
| 12 | −11082 | −12389 | | x | | x | | x | | | |
| 13 | −8384 | −9733 | | x | | x | | x | | x | |
| 14 | −5624 | −7004 | | x | | x | | x | | | |
| 15 | −2822 | −4223 | | x | x | x | x | x | | x | |
| 16 | 0 | −1411 | | x | x | x | x | x | x | | x |
| 17 | 2822 | 1411 | 1-5 | x | x | x | x | x | x | x | |
| 18 | 5624 | 4223 | 6-8 | x | x | x | x | x | x | | x |
| 19 | 8384 | 7004 | 9,10 | x | x | x | x | | x | x | |
| 20 | 11082 | 9733 | 11,12 | x | x | x | x | | x | | x |
| 21 | 13696 | 12389 | 13,14 | x | x | x | x | | x | | |
| 22 | 16210 | 14953 | 15 | x | x | x | x | | x | | x |
| 23 | 18602 | 17406 | 16,17 | x | x | x | x | | x | | |
| 24 | 20858 | 19730 | 18 | x | x | | x | | | | |
| 25 | 22958 | 21908 | 19,20 | x | x | | x | | | | |
| 26 | 24886 | 23922 | 21-24 | x | x | | | | | | |
| 27 | 26630 | 25758 | | x | x | | | | | | |
| 28 | 28176 | 27403 | | | x | | | | | | |
| 29 | 29512 | 28844 | | | x | | | | | | |
| 30 | 30628 | 30070 | | | x | | | | | | |
| 31 | 31518 | 31073 | | | | | | | | | |

TABLE 2-A

| VALUE | BIT PATTERN | NUMBER OF BITS |
|---|---|---|
| −7 | 11111111111110 | 14 |
| −6 | 111111111110 | 12 |
| −5 | 1111111110 | 10 |
| −4 | 11111110 | 8 |
| −3 | 111110 | 6 |
| −2 | 1110 | 4 |
| −1 | 10 | 2 |
| 0 | 0 | 1 |
| 1 | 110 | 3 |
| 2 | 11110 | 5 |
| 3 | 1111110 | 7 |
| 4 | 111111110 | 9 |
| 5 | 11111111110 | 11 |
| 6 | 1111111111110 | 13 |
| 7 | 111111111111110 | 15 |

TABLE 2-B

| NUMBER(n) OF BITS | VALUE | Q-VALUE | NUMBER (n) OF BITS | VALUE | Q-VALUE |
|---|---|---|---|---|---|
| 1 | 0 | 0 | 8 | −4 | −9/2 |
| 2 | −1 | −3/2 | 9 | 4 | 9/2 |
| 3 | 1 | 3/2 | 10 | −5 | −11/2 |
| 4 | −2 | −5/2 | 11 | 5 | 11/2 |
| 5 | 2 | 5/2 | 12 | −6 | −13/2 |
| 6 | −3 | −7/2 | 13 | 6 | 13/2 |
| 7 | 3 | 7/2 | 14 | −7 | −15/2 |
| | | | 15 | 7 | 15/2 |

TABLE 3

```
C — Calculate Lattice (Reflection) Coefficients K(I)
      from N(I) - the pre-emphasized signal packet values
C — Window Function
For I = 1 to 24
      W(I) = WF(I) * N(I)
      W(161−I) = WF(I) * N(161−I)
Next I
For I = 25 to 136
      W(I) = N(I)
Next I
C — Calculate Correlation Coefficients RC(I)
For I = 0 to 8
      RC(I) = 0
      For J = 1 to (160 − I)
            RC(I) = RC(I) + W(J) * W(J+I)
      Next J
```

TABLE 3-continued

```
Next I
C — Leroux-Gueguen Algorithm
F(1) = RC(1)
B(1) = RC(0)
K(1) = −F(1)/B(1)
B(1) = B(1) + ( K(1) * F(1) )
For I = 2 to 8
      F(I) = RC(I)
      B(I) = RC(I−1)
      For J = (I−1) to 1 by −1
            F(J) = F(J+1) + ( K(I−J) * B(J+1) )
            B(J+1) = B(J+1) + ( K(I−J) * F(J+1) )
      Next J
      K(I) = − F(1)/B(1)
      B(1) = B(1) + ( K(I) * F(1) )
Next I
```

TABLE 4

```
C — Feedforward Lattice Filter
C    Calculate residual signal R(I) values using
C          QK(I) = quantized lattice coefficients
C    Note: B(I) values from previous signal packet are
C          retained unless it was SILENCE, in which case
C          all B(I) were set to zero during the
C          processing of said previous packet
For I = 1 to 160
   F(0) = N(I)
   ZB(0) = N(I)
   For J = 1 to 7
         F(J) = F(J−1) + ( QK(J) * B(J−1) )
         ZB(J) = B(J−1) + ( QK(J) * F(J−1) )
         B(J−1) = ZB(J−1)
   Next J
   R(I) = F(7) + ( QK(8) * B(7) )
   B(7) = ZB(7)
Next I
```

TABLE 5

```
C — Determine Residual Signal State STATE
C    quantization step size SS, if applicable.
C — Notation:
C          E_SP = energy of unfiltered signal N(I)
C          E_RS = energy of residual signal R(I)
C          PV = peak (maximum) value of R(I)
C          SQRT = square root function
C          ABS = absolute value function
E_SP = 0
E_RS = 0
PV = 0
For I = 1 to 160
   E_RS = E_RS + ( R(I) * R(I) )
   E_SP = E_SP + ( N(I) * N(I) )
   IF ABS( R(I) ) .GT. PV THEN PV = ABS( R(I) )
Next I
PG = (4 * E_SP)/E_RS
Express E_RS as A*2^B,
   where A .LT. 32768 and B is an even integer
Using QE table (Table 11),
   find the smallest i such that QE(i) .GT. A
CC = QN(i) * 2^(B/2)
PE = ( 203 * PV ) / CC
IF ( PV .GT. PV_SGM ) AND ( PG .GT. 8 ) AND ( PE .GT. 9 )
   THEN STATE = SIGMA; SS = CC / 84; RETURN
IF ( E_RS .LT. E_RS_min ) AND ( PG .LT. 6 )
   THEN STATE = HISS; SSI =) 1; RETURN
STATE = PEAKY
SS = largest entry in step size table (Table 10)
   less than PV / 4
RETURN
```

TABLE 6

RESIDUAL SIGNAL QUANTIZATION AND NOISE SHAPING FILTER METHOD

```
C — Calculate Noise Filter Coefficients A(I)
C    Note: J/2 means INT(J/2)
C          When J=1, inner (I) loop is executed just once
```

TABLE 6-continued

RESIDUAL SIGNAL QUANTIZATION AND NOISE SHAPING FILTER METHOD

```
A(0) = K(0)
For J = 1 to 7
   A(J) = K(J)
   For I = 1 to J/2
         T = A(I) + ( K(J) * A(J−I) )
         A(J−I) = A(J−I) + ( K(J) * A(I) )
         A(I) = T
   Next I
Next J
C — Scale Noise Filter Coefficients
T = 1
For J = 0 to 7
   T = 3*T/4
   A(J) = T*A(J)
Next J
C — Run residual signal R(I) through quantizer and
C        noise shaping filter
C    Note: SIGN(X) = +1 if X .GE. 0
C                  = −1 if X .LT. 0
C          QR(I) = value of quantized residual signal
C    Note: ERR(I) values from previous signal packet are
C          retained unless it was SILENCE, in which case
C          all ERR(I) were set to zero during the
C          processing of said previous packet
For I = 1 to 160
   NOISE = A(0)*ERR(0) + A(1)*ERR(1) + A(2)*ERR(2) +
           A(3)*ERR(3) + A(4)*ERR(4) + A(5)*ERR(5) +
           A(6)*ERR(6) + A(7)*ERR(7)
   RN(I) = R(I) + NOISE
   J = 1
   QR(I) = 0
   Do While (J .LT. 8) AND (ABS(RN(I)) .GE. J*SS)
         QR(I) = SIGN(RN(I)) * (J+½) * SS
         J = J + 1
   END While
   ERR(7) = ERR(6)
   ERR(6) = ERR(5)
   ERR(5) = ERR(4)
   ERR(4) = ERR(3)
   ERR(3) = ERR(2)
   ERR(2) = ERR(1)
   ERR(1) = ERR(0)
   ERR(0) = RN(I) − QR(I)
Next I
```

TABLE 7

```
C — Derive Lattice Coefficients K(I)
C    from encoded B1, B2, B3, B4
C    using Modulo function, wherein
C    (1) INT(A/B) = integer division of A by B
C    (2) A Modulo B = A − B*INT(A/B)
KI(1) = 5 + (B1 Modulo 23)
KI(2) = 15 + (B2 Modulo 16)
KI(3) = 8 + INT(B2 / 16)
KI(4) = 15 + INT(B1 / 23)
KI(5) = 11 + INT(B3 / 32)
KI(7) = 13 + 2 * (B3 Modulo 4)
KI(6) = 16 + (INT(B3/4) Modulo 8)
KI(8) = 16 + 2*B4
```

TABLE 8

```
C — Reconstruct Audio Signal using Lattice Filter
C    and De-emphasis Filter
C    QR(I) = quantized residual signal
C    QN(I) = reconstructed signal
C    Note: B(I) values from previous signal packet are
C          retained unless it was SILENCE or HISS, in
C          which case all B(I) were set to zero during
C          the processing of said previous packet.
C          QN(0) = QN(160) from previous packet.
For I = 1 to 160
   F(8) = QR(I)
   For J = 8 to 1 by −1
         F(J−1) = F(J) − ( K(J) * B(J−1) )
         B(J) = B(J−1) + ( K(J) * F(J−1) )
   Next J
```

TABLE 8-continued

```
   B(0) = F(0)
C — De-emphasis
      QN(I) = ½QN(I−1) − F(0)
Next I
```

TABLE 9

```
C — Algorithm for generating Silence and Hiss sounds
C    RAND = a random number between 0 and 10,000
C    NSCL = noise scaling factor
RAND = remainder( ( (RAND*7777) + 7777) / 10000)
NOISE = (RAND − 5000) / NSCL
```

TABLE 10

| SSI | SS (STEP SIZE VALUE) | SSI | SS |
|---|---|---|---|
| 0 | SILENCE | 33 | 230 |
| 1 | HISS | 34 | 252 |
| 2 | 14 | 35 | 274 |
| 3 | 16 | 36 | 300 |
| 4 | 18 | 37 | 326 |
| 5 | 20 | 38 | 358 |
| 6 | 22 | 39 | 390 |
| 7 | 24 | | |
| 8 | 26 | | |
| 9 | 28 | | |
| 10 | 30 | | |
| 11 | 34 | | |
| 12 | 36 | | |
| 13 | 40 | | |
| 14 | 44 | | |
| 15 | 48 | | |
| 16 | 52 | | |
| 17 | 56 | | |
| 18 | 62 | | |
| 19 | 68 | | |
| 20 | 74 | | |
| 21 | 80 | | |
| 22 | 88 | | |
| 23 | 96 | | |
| 24 | 106 | | |
| 25 | 114 | | |
| 26 | 126 | | |
| 27 | 136 | | |
| 28 | 150 | | |
| 29 | 162 | | |
| 30 | 178 | | |
| 31 | 194 | | |
| 31 | 212 | | |

TABLE 11

ENERGY QUANTIZATION AND SQUARE ROOT TABLE
QE(i) = Quantized Energy
QN(i) = 4 * SQRT(QE(i))
QE and QN values are logarithmically spaced:
2*QE(i) = QE(i+4)
2*QN(i) = QN(i+8)

| i | QE(i) | QN(i) | i | QE(i) | QN(i) |
|---|---|---|---|---|---|
| 1 | 128 | 46 | 24 | 8192 | 362 |
| 2 | 152 | 50 | 25 | 9472 | 394 |
| 3 | 181 | 54 | 26 | 11585 | 430 |
| 4 | 215 | 58 | 27 | 13777 | 470 |
| 5 | 256 | 64 | 28 | 16384 | 512 |
| 6 | 362 | 70 | 29 | 19484 | 558 |
| 7 | 430 | 82 | 30 | 23170 | 608 |
| 8 | 512 | 90 | 31 | 27554 | 664 |
| 9 | 609 | 98 | 32 | 32767 | 724 |
| 10 | 725 | 108 | 33 | 38968 | 790 |
| 11 | 861 | 118 | 34 | 46340 | 861 |
| 12 | 1024 | 128 | | | |
| 13 | 1218 | 140 | | | |
| 14 | 1448 | 152 | | | |
| 15 | 1772 | 166 | | | |
| 16 | 2048 | 180 | | | |
| 17 | 2435 | 198 | | | |
| 18 | 2896 | 216 | | | |
| 19 | 3444 | 234 | | | |

TABLE 11-continued

ENERGY QUANTIZATION AND SQUARE ROOT TABLE
QE(i) = Quantized Energy
QN(i) = 4 * SQRT(QE(i))
QE and QN values are logarithmically spaced:
2*QE(i) = QE(i+4)
2*QN(i) = QN(i+8)

| i | QE(i) | QN(i) | i | QE(i) | QN(i) |
|---|---|---|---|---|---|
| 20 | 4096 | 256 | | | |
| 21 | 4871 | 280 | | | |
| 22 | 5793 | 304 | | | |
| 23 | 6889 | 332 | | | |

What is claimed is:

1. In a method of processing a series of digital signal packets representing an audio signal, each said signal packet comprising a series of digital values corresponding to the amplitude of the audio signal during successive time subintervals, the steps comprising:

(a) classifying each said signal packet as being in one of a multiplicity of predefined states; and (b) encoding each said signal packet in a manner depending on the state of said signal packet, including, for each signal packet classified as being in any of a first subset of said predefined states, the steps of generating and encoding a set of prediction signals;

removing the predictable part of said signal packet represented by said prediction signal; and encoding the residual portion of said signal packet remaining after said removing step, by quantizing ditigal values corresponding to the amplitude of said residual portion during successive time subintervals using a quantization method which depends on said state of said signal packet;

wherein said first subset includes a plurality of said predefined states.

2. In a method as set forth in claim 1, wherein said classifying step includes pre-emphasizing said audio signal to even out the spectral energy distribution of said audio signal.

3. In a method as set forth in claim 1, said step (b) including:

for at least each signal packet characterized as being in a first predefined state (SILENCE) not in said first subset of predefined states, encoding the signal packet in a manner not depending on the detailed structure of the signal packet.

4. In a method as set forth in claim 1, wherein the state of each signal packet is a function of the signal packet's energy, and, if the energy is above a preselected threshold value, the energy of said residual signal, and the peak value of said residual signal.

5. In a method as set forth in claim 4, wherein said classifying step includes classifying said signal packet as being in a first predefined state (SILENCE) that is not included in said first subset if said signal packet's energy is not above said preselected threshold value; and said encoding step includes encoding signal packets classified as being in said first predefined state (SILENCE) solely as a signal packet in said first predefined state.

6. In a method as set forth in claim 4, wherein said classifying step includes, for signal packets having energy above said preselected threshold value, the steps of:

removing the predictable part of said signal packet represented by said prediction signal; and classifying said signal packet as being in a second predefined (HISS) state when the predictive gain of said signal packet, comprising the ratio of the signal packet energy to the residual signal packet energy, is less than a first preselected gain value, and the residual signal packet energy is less than a preselected residual threshold value.

7. A method as set forth in claim 6, wherein said classifying step further includes, for signal packets having energy above said preselected threshold value, the steps of:

classifying said signal packet as being in a third predefined (SIGMA) state when the predictive gain of said signal packet is greater than a second preselected gain value, the peak value of said residual signal is greater than a preselected amplitude value, and the ratio of the peak value of said residual signal to the square root of the residual signal packet's energy is greater than a preselected value.

8. In a method as set forth in claim 7, wherein said encoding step includes:

for at least each signal packet characterized as being in said third (SIGMA) state, quantizing said residual signal using a step size proportional to the variance of said residual signal.

9. In a method as set forth in claim 8, wherein said classifying step includes:

determining if said signal is in a fourth (PEAKY) state, said fourth (PEAKY) state being distinct from said first (SILENCE), second (HISS) and third (SIGMA) states; and said encoding step includes:

for at least each signal packet characterized as being in said fourth (PEAKY) state, quantizing said residual signal using a step size proportional to the peak value of said residual signal.

10. In a method as set forth in claim 9, wherein said step size used to quantize the residual signal of signal packets characterized as being in said fourth (PEAKY) state is no greater than one third of said peak value and no less than one fifth of said peak value.

11. In a method as set forth in claim 10, wherein said quantizing step uses a step size from a preselected set of quantized step size values.

12. In a method as set forth in claim 1, wherein said encoding step includes:

reducing the noise caused by said quantizing by calculating the quantization noise for each time subinterval and adding to the digital value for each time interval predetermined fractions of at least two of the quantization noise values for the previous time subintervals.

13. In a method as set forth in claim 11, wherein said generating step includes:

windowing a preselected portion of said signal packet using a window function which is at least approximately proportional to the square of the cosine function.

14. A method of encoding an audio signal comprising the steps of:

representing said audio signal as a series of digital signal packets, each said signal packet comprising a series of digital values corresponding to the amplitude of the audio signal during successive time subintervals;

calculating an energy value corresponding to the energy level of each said signal packet;

classifying and encoding said signal packet as being in a first predefined (SILENCE) state if said energy value is less than a first predefined energy level; and for signal packets not classified as being in said first predefined (SILENCE) state, performing the steps of:

generating a set of prediction signals representing the predictable part of said signal packet;

generating a residual signal by removing the predictable part of said signal packet represented by said prediction signals; said residual signal comprising a series of residual digital values corresponding to the amplitude of said audio signal, with said predictable part removed, during successive time subintervals;

classifying said signal packet as being in one of a plurality of predefined states, in accordance with the energy level of said residual signal and the peak value of said residual signal; and encoding said signal packet in accordance with its classified state; said encoding step including, for signal packets classified as being in any of said states included in a predefined subset of at least two of said predefined states, encoding said prediction signals, and encoding said residual signal by quantizing said residual digital values using a step size which depends on said state of said signal packet.

15. The method set forth in claim 14, wherein said second classifying step includes classifying said signal packet as being in a second predefined (HISS) state when the predictive gain of said signal packet, comprising the ratio of the signal packet energy to the residual signal packet energy, is less than a first preselected gain value, and the residual signal packet energy is less than a preselected residual threshold value.

16. The method set forth in claim 15, wherein said second classifying step further includes, for signal packets having energy above said preselected threshold value, the step of classifying said signal packet as being in a third predefined (SIGMA) state when the predictive gain of said signal packet is greater than a second preselected gain value, the peak value of said residual signal is greater than a preselected amplitude value, and the ratio of the peak value of said residual signal to the square root of the residual signal packet's energy is greater than a preselected value.

17. The method set forth in claim 16, wherein said encoding step includes:

for at least each signal packet classified as being in said third (SIGMA) state, quantizing said residual signal using a step size proportional to the variance of said residual signal.

18. The method set forth in claim 17, wherein said second classifying step includes:

determining if said signal is in a fourth (PEAKY) state distinct from said first (SILENCE), second (HISS) and third (SIGMA) states; and said encoding step includes:

for at least each signal packet characterized as being in said fourth (PEAKY) state, quantizing said residual signal using a step size proportional to the peak value of said residual signal.

19. The method set forth in claim 14, wherein said encoding step includes:

reducing the noise caused by said quantizing step, by calculating the quantization noise for each time subinterval and adding to the residual signal value for each time interval predetermined fractions of the quantization noise values for at least two of the previous time subintervals.

20. Apparatus for encoding an audio signal, comprising:

digitizing means for representing said audio signal as a series of digital signal packets, each said signal packet comprising a series of digital values corresponding to the amplitude of the audio signal during successive time subintervals;

silent signal handling means, including energy means for calculating an energy value for each said signal packet, and silent signal packet encoding means for classifying and encoding said signal packet as being in a first predefined (SILENCE) state if said energy value is less than a first predefined energy level; and nonsilent signal processing means, for processing signal packets not classified as being in said first predefined (SILENCE) state, including:

prediction means for generating a set of prediction signals representing the predictable part of said signal packet;

residual signal generating means for generating a residual signal by removing the predictable part of said signal packet represented by said prediction signals; said residual signal comprising a series of residual digital values corresponding to the amplitude of said audio signal, with said predictable part removed, during successive time subintervals;

residual energy means for calculating a residual energy value for residual signal;

classifying means for classifying said signal packet as being in one of a plurality of predefined states, in accordance with said residual energy value and the peak value of said residual signal; and encoding means for encoding said signal packet by encoding: (a) the classified state of said signal packet, (b) said prediction signals for said signal packet; and (c) for signal packets classified as being in any of said states included in a predefined subset of at least two of said predefined states, said residual signal; said residual signal being encoded by quantizing said residual digital values using a step size which depends on said state of said signal packet.

21. Apparatus as set forth in claim 20, wherein said classifying means includes means for classifying said signal packet as being in a second predefined (HISS) state, not included in said predefined subset of states, when the predictive gain of said signal packet, comprising the ratio of the signal packet energy to the residual signal energy, is less than a first preselected gain value, and the residual signal energy is less than a preselected residual threshold value; and said encoding means encodes only said signal state and said prediction signals for signal packets classified as being in said second predefined (HISS) state.

22. Apparatus as set forth in claim 21, wherein:

said silent signal handling means includes means for encoding signal packets classified as being in said first specified state (SILENCE) in a manner not depending on the said series of digital values for said signal packet.

23. Apparatus as set forth in claim 21, wherein said classifying means includes means for classifying a signal packet as being in a third (SIGMA) state, included in said predefined subset of states, when the predictive gain of said signal packet is greater than a second preselected gain value, the peak value of said residual signal is greater than a preselected amplitude value, and the ratio of the peak value of said residual signal to the square root of said residual energy value is greater than a preselected value, and for otherwise classifying said signal packet as being in another state which is included in said predefined subset of states.

24. Apparatus as set forth in claim 20, wherein said digitizing means includes means for pre-emphasizing said audio signal to even out the spectral energy distribution of said audio signal.

25. Apparatus as set forth in claim 20, wherein said prediction means includes means for selecting prediction signal values for each signal packet from a preselected set of quantized prediction signal values.

26. Apparatus as set forth in claim 25, wherein said encoding means includes means for selecting said step size from a preselected set of quantized step size values.

* * * * *